United States Patent [19]

Allen

[11] Patent Number: 4,544,346

[45] Date of Patent: Oct. 1, 1985

[54] CONCRETE SCREED WITH CURB FORMING APPARATUS

[75] Inventor: J. Dewayne Allen, Paragould, Ark.

[73] Assignee: Allen Engineering Corporation, Paragould, Ark.

[21] Appl. No.: 581,379

[22] Filed: Feb. 17, 1984

Related U.S. Application Data

[63] Continuation-in-part of Ser. No. 457,727, Jan. 13, 1983, Pat. No. 4,466,757.

[51] Int. Cl.[4] ..... E01C 19/38

[52] U.S. Cl. ..... 425/456; 404/98; 404/114; 404/119; 425/63; 425/218

[58] Field of Search ..... 425/63, 456, 218, 458; 404/114, 119, 96, 98, 118; 249/1, 2

[56] References Cited

U.S. PATENT DOCUMENTS

| | | | |
|---|---|---|---|
| 3,224,348 | 12/1965 | Maginniss | 404/114 |
| 3,377,933 | 4/1968 | Dale | 404/119 |
| 3,412,658 | 11/1968 | Griffin | 404/119 |
| 3,475,800 | 11/1969 | Jones | 425/63 |
| 4,314,773 | 2/1982 | Allen | 404/119 |
| 4,316,715 | 2/1982 | Allen | 425/456 |
| 4,397,580 | 8/1983 | Morrisson | 425/63 |
| 4,397,626 | 8/1983 | Morrisson | 425/456 |
| 4,412,803 | 11/1983 | Allen | 425/456 |

*Primary Examiner*—Willard E. Hoag
*Assistant Examiner*—James C. Housel
*Attorney, Agent, or Firm*—Cahill, Sutton & Thomas

[57] ABSTRACT

The present invention simultaneously finishes the surface of an area of plastic concrete and forms a curb along one or both sides of the area as the apparatus is translated along the length of the area. The apparatus includes a vibratory concrete finishing machine such as a triangular truss concrete screed having first and second sides and spaced apart front and rear screed blades. The two sides of the finishing machine are supported by roller support units which engage each of the spaced apart forms. Coupling means connects the first roller support unit to the first side of the finishing machine, adjusts the lateral spacing between the first side of the finishing machine and the form, and adjusts the elevation of the screed blades with respect to the form. A curb form is coupled to the finishing machine between the form and the first side of the finishing machine.

9 Claims, 3 Drawing Figures

CONCRETE SCREED WITH CURB FORMING APPARATUS

This application is a Continuation-in-Part application of U.S. patent application Ser. No. 457,727, filed Jan. 13, 1983 now U.S. Pat. No. 4,466,757.

BACKGROUND OF THE INVENTION

1. Field of the Invention

This invention relates to concrete finishing machines, and more particularly, to a concrete finishing machine for simultaneously finishing a plastic concrete surface and for forming a curb along a side of said plastic concrete surface.

2. Description of the Prior Art

Various types of expensive, highly sophisticated and complex equipment have been available for simultaneously finishing a plastic concrete surface and forming curbs on the sides of an area of plastic concrete. In addition, various types of comparatively inexpensive concrete finishing equipment in the form of triangular truss screeds have been available in the past as well as numerous attachments and accessories for these devices. See for example, U.S. Pat. No. 4,316,715 (Allen) which discloses a vibratory concrete screed having spaced apart front and rear screed blades in combination with numerous different types of accessories and attachments for finishing a plastic concrete surface. The '715 patent specifically discloses a vertically and laterally adjustable blade extension bracket for forming a step on the side surface of an area of plastic concrete.

SUMMARY OF THE INVENTION

It is therefore a primary object of the present invention to provide apparatus capable of simultaneously finishing the surface of an area of plastic concrete and forming a curb having a desired contour along one or both sides of said area.

Another object of the present invention is to provide apparatus including elevation and lateral adjustment means for controlling the height and width of the curb formed by said apparatus.

Yet another object of the present invention is to provide apparatus including vibrating means for imparting vibratory motion to the curb form to facilitate production of a smooth and uniform curb.

Still another object of the present invention is to provide means for isolating the vibrating motion of said curb form from the remainder of the finishing machine.

Briefly stated, and in accord with one embodiment of the invention, a concrete screed with curb forming apparatus includes front and rear spaced apart screed blades and roller support means coupled to each side of the finishing machine. The first roller support means engages one of said forms. Coupling means connects the first roller support means to the first side of the finishing machine, adjusts the lateral spacing between the first side of the finishing machine and the form, and adjusts the elevation of the screed blades with respect to the form. Means is coupled to the finishing machine between the form and the first side of said machine for forming a curb having a desired contour adjacent to the form.

DESCRIPTION OF THE DRAWINGS

The invention is pointed out with particularity in the appended claims. However, other objects and advantages together with the operation of the invention may be better understood by reference to the following detailed description taken in combination with the following illustrations, wherein:

DESCRIPTION OF THE PREFERRED EMBODIMENT

In order to better illustrate the advantages of the invention and its contributions to the art, a preferred hardware embodiment of the invention will now be described in detail.

Figure 1:
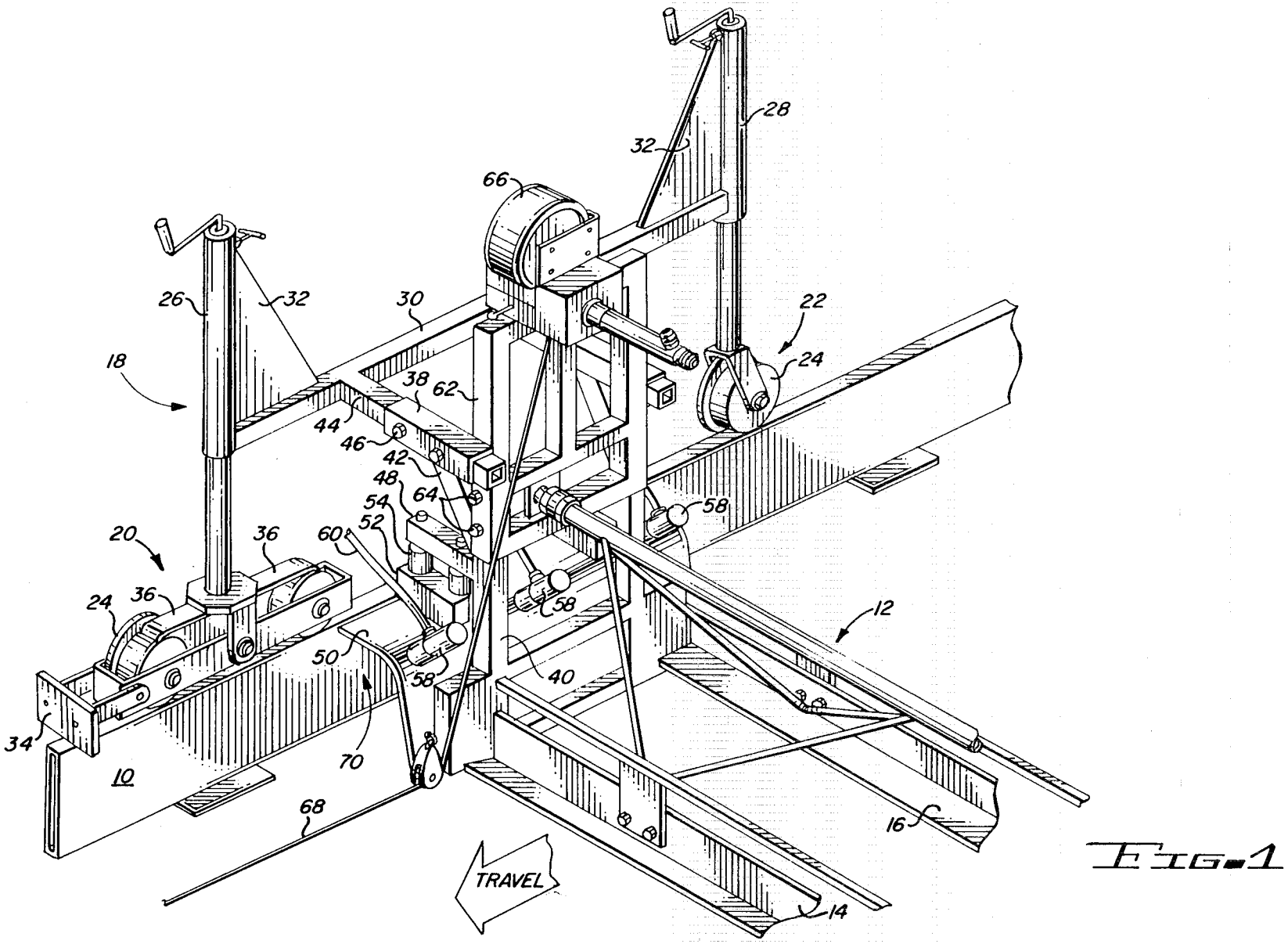
FIG. 1 is a partially cutaway perspective view depicting one end of the finishing machine of the present invention together with the curb forming means.
Figure 2:
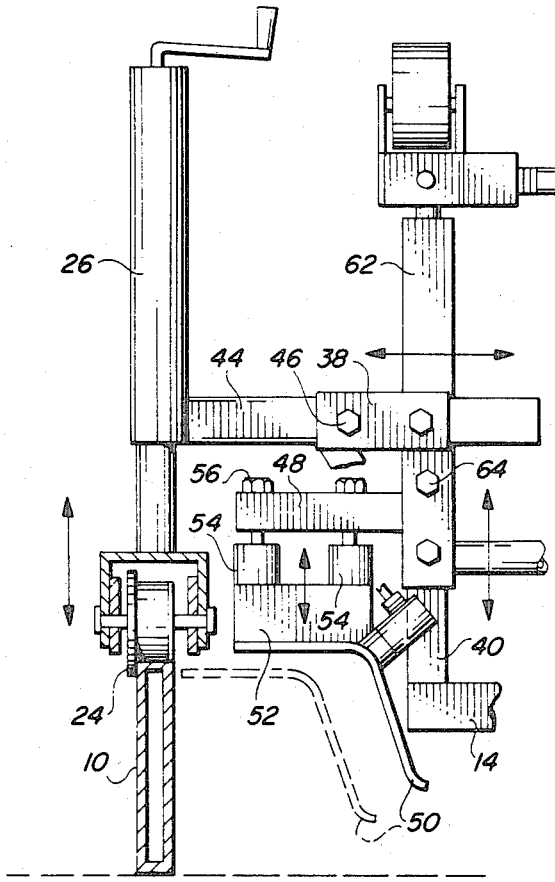
FIG. 2 is a partially cutaway end view of the apparatus depicted in FIG. 1, particularly depicting the manner in which the curb forming means of the present invention can be laterally and vertically adjusted.
Figure 3:
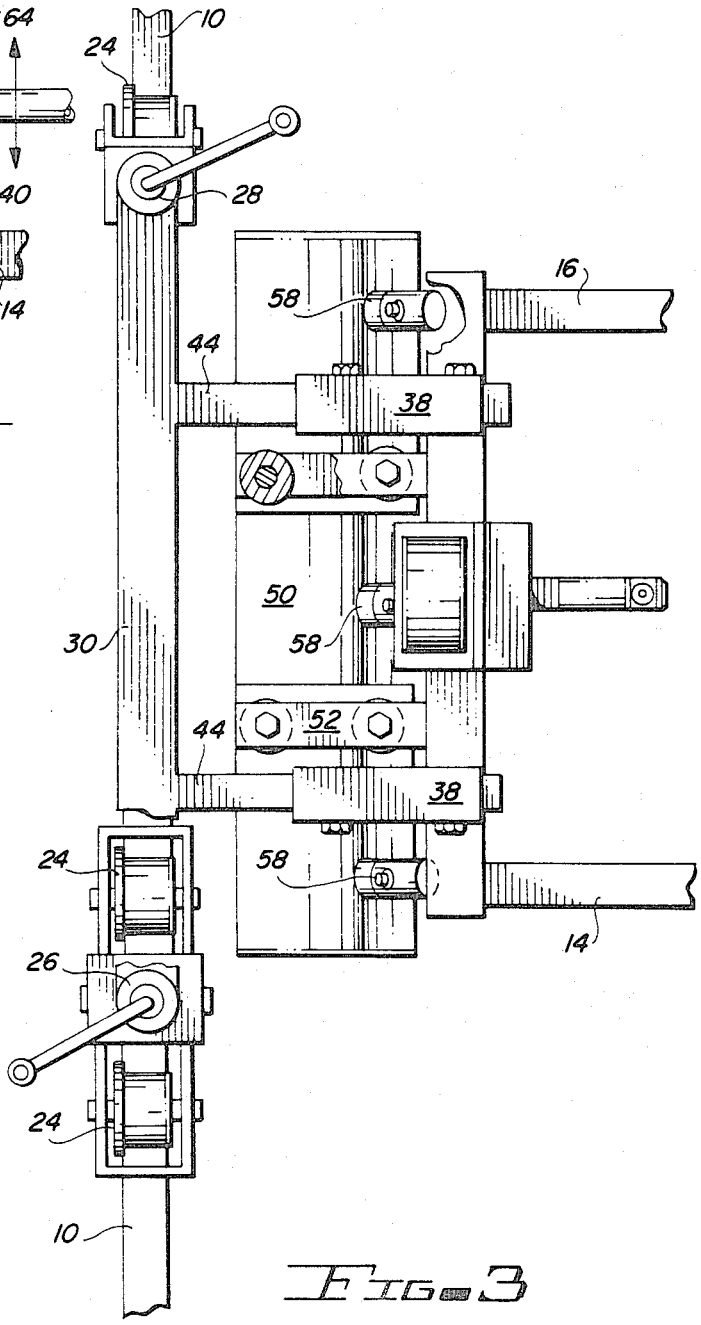
FIG. 3 is a partially cutaway view from above of the end section of the concrete finishing machine depicted in FIG. 2.

Referring to FIGS. 1–3, a concrete form 10 is positioned adajcemt to the sides of an area of plastic concrete. A triangular truss concrete screed 12 of the type commercially available from the Allen Engineering Corporation of Paragould, Arkansas includes a front screed blade L4 and a spaced apart rear screed blade 16.

A first roller support unit 18 includes first and second spaced apart roller assemblies 20 and 22. The rollers of these roller assemblies include flanged wheels 24 which engage and are supported by the upper surface of concrete form 10. Vertically oriented jack screw assemblies 26 and 28 are coupled together by a horizontally oriented support bar 30. Reinforcing plates 32 maintain a fixed angular position between jack screws 26 and 28 and support bar 30.

First roller assembly 20 includes a rubber wiper plate which is pivotally coupled to the front end of first roller assembly 20 in a manner permitting free vertical displacements of wiper plate 34. As the concrete finishing machine is advanced forward along concrete form 10, wiper plate 34 engages the upper surface of form 10 and removes excess plastic concrete from that surface , assuring uniform contact between flanged wheels 24 and form 10.

Spring biased concrete scraper bars 36 engage the load bearing periphery of flanged wheels 24 and remove undesired plastic concrete to maintain uniform contact between flanged wheel 24 and the upper surface of form 10.

A pair of spaced apart, horizontally oriented, tubular brackets 38 are coupled to end handle 40 of the concrete finishing machine. Angled reinforcing members 42 assist in maintaining bracket 38 in the horizontal plane.

A pair of horizontally oriented bracket sections 44 are coupled to support bar 30 and are telescopically fitted within each of the two spaced apart tubular brackets 38 to provide for lateral spacing adjustments between screed 12 and form 10. A pair of spaced apart locking screws 46, when tightened, prevent lateral displacement between tubular bracket 38 and bracket sections 44.

In the FIG. 1 embodiment of the invention, a pair of horizontally oriented curb form brackets 48 are rigidly coupled to and extend laterally out from end handle 40. A curb form plate 50 is coupled to curb form brackets 48 by a pair of spaced apart spacer brackets 48 by a pair of spaced apart spacer brackets 52 and first and second spaced apart rubber shock mount assemblies 54. The shock mount assemblies 54 are coupled to curb form brackets 48 by vertically oriented bolts 56 as indicated in the drawings.

Three pneumatically powered air vibrator units 58 are coupled to curb plate 50 at uniformly spaced apart intervals as depicted in the drawings. An air hose 60 couples each air vibrator unit 58 to a source of compressed air. In vibratory concrete screeds of the type depicted, vibratory motion is typically imparted to front and rear screed blades 14 and 16 by a plurality of spaced apart air vibrator units. In a finishing machine having that configuration, the air hoses 60 are coupled to a source of compressed air which drives the air vibrator units coupled to screed blades 14 and 16.

Rubber shock mount assemblies 54 have been provided to isolate the vibrations generated by the spaced apart vibrator units 58 from the vibration generating mechanisms coupled to vibrate front or screed blades 14 or 16. It has been found that provisions of the shock mount assemblies 54 improves the operation of the curb forming apparatus of the present invention and minimizes vibrational interference between the curb form apparatus and the front and rear screeds 14 and 16 of the screed 12.

FIGS. 1 and 2 indicate that a curb form plate 50 is adjusted into substantially abutting contact with the vertically oriented side surface of concrete form 10. Such lateral adjustment is obtained by telescopically adjusting bracket sections 44 with respect to tubular brackets 38. Jack screw assemblies 26 and 28 are operated to obtain the desired vertical offset between the upper surface of concrete form 10 and the lower surfaces of front and rear screed blades 14 and 16.

FIG. 2 depicts a second embodiment of the invention in which a vertically oriented bracket 62 is telescopically adjustable with respect to vertically oriented end handle 40. A pair of spaced apart locking bolts 64 serve to maintain a fixed vertical position between end handle 40 and vertical bracket 62. Relative vertical adjustments of vertical bracket 62 with respect to end handle 40 adjusts the relative height of the curb with respect to the upper surface of the finished concrete by adjusting the vertical spacing between the upper surface of curb form plate 50 and the lower surface of front and rear screed blades 14 and 16.

The FIG. 1 embodiment in which the relative vertical spacing between curb form plate 50 and front and rear screed blades 14 and 16 cannot be adjusted will be acceptable for use in most applications. When additional vertical adjustment capability is required, the FIG. 2 embodiment can be utilized.

By utilizing the various available vertical and horizontal adjustment features, the position, height, configuration and other characteristics of the curb formed by the operation of the present invention can be easily and accurately adjusted to provide the desired curb configuration. In addition, curb form plates 50 of various configurations can readily be fabricated and attached to the present invention in the field to create various different curb configurations. The present invention can be operated either with or without vibrator units 58 although it has been found that substantially improved operation may be achieved by utilization of these devices.

Linear translation of the finishing machine with respect to form 10 is accomplished by either manual, hydraulic or electric actuation of winch units 66 which are coupled by a steel cable 68 to a fixed point positioned in front of the finishing device. As the finishing machine is advanced forward through the area of plastic concrete, an individual standing in or adjacent to the plastic concrete surface typically utilizes a shovel or equivalent tool to feed plastic concrete into the front opening of curb form plate 50 as depicted by reference number 70. In this manner, an adequate supply of concrete is provided to the curb form unit of the present invention.

It will be apparent to those skilled in the art that the disclosed concrete screed with curb forming apparatus may be modified in numerous ways and may assume many embodiments other than the preferred forms specifically set out and described above. Accordingly, it is intended by the appended claims to cover all such modifications of the invention which fall within the true spirit and scope of the invention.

I claim:

1. Apparatus for simultaneously finishing the surface of an area of plastic concrete and forming a curb along a side of said area as said apparatus is translated along the length of said area, the edge of said area being defined by a concrete form including a linear upper surface and a vertically oriented, planar inner surface, said apparatus comprising:

a. a triangular truss screed having an end and including spaced apart substantially linear front and rear screed blades terminating at the end of said screed and forming the base of said truss, said screed further including a horizontally oriented structural member forming the apex of said truss and vibration generating means for transmitting vibrations to said front and rear screed blades;

c. means for translating said apparatus along said concrete form;

d. a curb form fabricated from a continuous sheet of substantially rigid material including an upper finishing surface having a first linear edge and an interior finishing surface having a second linear edge;

e. screed support means coupled to the first and second struts of said end handle for maintaining the end of said screed inboard of said concrete form and for supporting said front and rear screed blades at a level below the upper surface of said concrete form to thereby create an unobstructed curb forming gap extending laterally between the end of said screed and the inner surface of said concrete form and extending vertically from the lower surface of said front and rear screed blades to a height above the upper surface of said concrete form, said screed support means including i. a first roller unit for engaging the upper surface of said concrete form and enabling said screed support means to be translated along said form;

ii. bracket means coupled to said first roller unit at an elevation above the upper surface of said concrete form and having first clamping means for engaging the first and second struts of said end handle to secure said screed support means to said end handle at a selected elevation to control the height differential between the upper surface of said concrete form and said front and rear screed blades;

f. a curb form support bracket coupled to said end handle at an elevation above the upper surface of said concrete form and extending into the curb forming gap toward the inner surface of said concrete form; and g. vibration isolation means coupled to said curb form support bracket and to the upper surface of said curb form for securing said curb form to said curb form support bracket within the curb forming gap, for maintaining the first linear edge of said curb form parallel to the inner surface of said concrete form, and for attenuating the transmission of vibration from said screed to said curb form;

Wherein said first clamping means is secured to said end handle at an elevation which aligns the first linear edge of said curb form in substantially abutting contact with the inner surface of said concrete form to create a closed curb forming chamber between said curb form and said concrete form at a location outboard of said screed end handle.

2. The apparatus of claim 1 wherein said bracket means further includes lateral adjustment means for varying the lateral spacing between said end handle and said concrete form to thereby control the width of said curb forming gap and to laterally align the first linear edge of said curb form with the inner surface of said concrete form.

3. The apparatus of claim 1 further including means coupled to the upper surface of said curb form for vibrating said curb form.

4. The apparatus of claim 1 wherein said vibration means includes first, second and third spaced apart vibrators.

5. The apparatus of claim 4 wherein said first, second and third vibrators are pneumatically powered.

6. The apparatus of claim 2 wherein the second linear edge of said curb form extends below and under the edges of said front and rear screed blades in proximity to said end handle.

7. The apparatus of claim 1 wherein said vibration isolation means comprises a plurality of rubber shock mounts.

8. The apparatus of claim 1 wherein said curb form includes a length equal to or greater than the spacing between said front and rear screed blades.

9. The apparatus of claim 1 wherein said first roller unit includes first and second spaced apart rollers each engaging the upper surface of said concrete form.

* * * * *